United States Patent [19]

Propst et al.

[11] 4,443,986

[45] Apr. 24, 1984

[54] PANEL CONSTRUCTION SYSTEM

[75] Inventors: Paul L. Propst, Holland; Larry P. Gzym, Rockford; Ralph Murrel, Grand Rapids; Donald A. Richardson, Kentwood; Carl B. Hinrichs, Grand Haven, all of Mich.

[73] Assignee: Stow/Davis Furniture Company, Grand Rapids, Mich.

[21] Appl. No.: 358,277

[22] Filed: Mar. 15, 1982

[51] Int. Cl.[3] ..... E04B 2/74; E04C 2/38

[52] U.S. Cl. ..... 52/239; 52/481; 52/578

[58] Field of Search ..... 160/135; 52/238-242, 52/578-584, 481, 489

[56] References Cited

U.S. PATENT DOCUMENTS

| | | | |
|---|---|---|---|
| Re. 27,215 | 11/1971 | Propst et al. | 52/36 |
| D. 246,889 | 1/1978 | Eckerline | D8/382 |
| D. 248,823 | 8/1978 | Eckerline | D8/382 |
| 1,725,120 | 8/1929 | Williams . | |
| 1,748,536 | 2/1930 | Borden . | |
| 1,965,597 | 7/1934 | Koenig | 189/34 |
| 2,010,412 | 8/1935 | Parsons | 52/481 |
| 2,033,100 | 3/1936 | Kellogg | 52/489 |
| 2,092,372 | 9/1937 | Goeller | 173/263 |
| 2,137,767 | 11/1938 | Betcone | 52/274 |
| 2,388,201 | 10/1945 | Wohlhieter | 24/81 |
| 2,763,890 | 9/1956 | Cox | 16/158 |
| 2,963,131 | 12/1960 | Brockway | 189/38 |
| 3,034,187 | 5/1962 | Hebard | 24/81 |
| 3,072,226 | 1/1963 | Harwood | 189/34 |
| 3,174,590 | 3/1965 | Haker | 189/34 |
| 3,245,642 | 4/1966 | Dicke | 248/43 |
| 3,251,163 | 5/1966 | Russell | 52/282 |
| 3,268,946 | 8/1966 | Case | 16/158 |
| 3,286,412 | 11/1966 | Greig et al. | 52/621 |
| 3,425,171 | 2/1969 | Propst et al. | 52/36 |
| 3,430,997 | 3/1969 | Propst et al. | 287/189.36 |
| 3,517,467 | 6/1970 | Propst et al. | 52/36 |
| 3,537,217 | 11/1970 | Lickliter et al. | 52/122 |
| 3,592,288 | 7/1971 | Walter | 181/30 |
| 3,592,289 | 7/1971 | Aysta | 181/30 |
| 3,638,387 | 2/1972 | Lickliter et al. | 52/741 |
| 3,698,147 | 10/1972 | Sikes | 52/582 |
| 3,802,146 | 4/1974 | Tacke et al. | 52/624 |
| 3,830,030 | 8/1974 | Yoshida et al. | 52/584 |
| 3,831,330 | 8/1974 | Tacke et al. | 52/220 |
| 3,834,093 | 9/1974 | Tacke et al. | 52/71 |
| 3,856,244 | 12/1974 | Manshen | 248/54 R |
| 3,948,011 | 4/1976 | Price et al. | 52/241 |
| 4,034,535 | 7/1977 | Dustmann | 52/727 |
| 4,100,709 | 7/1978 | Good | 52/239 |
| 4,123,879 | 11/1978 | Blodee et al. | 52/36 |
| 4,128,979 | 12/1978 | Price | 52/241 |
| 4,183,485 | 1/1980 | Gladieux | 248/68 R |
| 4,189,884 | 2/1980 | Pecoraro | 52/285 |
| 4,192,106 | 3/1980 | Hell | 52/36 |
| 4,204,375 | 5/1980 | Good | 52/239 |
| 4,214,646 | 7/1980 | Planes et al. | 181/287 |
| 4,219,101 | 8/1980 | Valsvik | 181/286 |
| 4,224,721 | 9/1980 | Ohlson | 24/81 TH |
| 4,232,183 | 11/1980 | Person | 52/221 |

*Primary Examiner*—James L. Ridgill, Jr.

*Attorney, Agent, or Firm*—Price, Heneveld, Huizenga & Cooper

[57] ABSTRACT

The specification discloses an office landscaping system comprising a plurality of wall panels supported on a support structure. The support structure comprises a plurality of frames each including a plurality of gussets extending outwardly therefrom, the gussets in turn each defining an upwardly opening slot. Also provided are clamping means for clamping together adjacent gussets on adjacent frames to secure the frame together. Mounting studs extend from each panel into the gusset slots to releasably suspend the panels on the support structure.

20 Claims, 9 Drawing Figures

PANEL CONSTRUCTION SYSTEM

BACKGROUND OF THE INVENTION

The present invention relates to panel construction systems, and more particularly panel construction systems including a support assembly and panel skins mounted thereon.

Modular wall panel construction assemblies are often used to divide a large room into a number of work areas separated by movable partitions which support both wall panels and desks. These office landscaping systems provide a relatively high concentration of work areas at relatively low cost, eliminating the need for expensive floor-to-ceiling partitions requiring permanent building modification. The work areas, which are open at their tops, can be supplied with ambient light from a common source. Further, heating, cooling, and ventilation are facilitated because of the openness of the work areas.

Typically, office landscaping systems comprise a plurality of wall panel sections, which are fastened together end-to-end. These panel sections comprise either (1) a relatively thick panel having mounting means on either end of the panel or (2) panel support frames to which are permanently secured panel skins. Consequently, the panel sections are relatively heavy, making installation and subsequent rearrangement relatively difficult. Further, custom wiring the panel sections is difficult because access may not be easily had to the panel section interiors. Examples of these systems may be seen in U.S. Pat. No. 3,834,093, entitled PANEL JOINTURE SYSTEM, issued Sept. 10, 1974, to Tacke et al; U.S. Pat. No. 3,831,330, entitled PANEL SYSTEM, issued Aug. 27, 1974, to Tacke et al; and U.S. Pat. No. 3,802,146, entitled PANEL SYSTEM, issued Apr. 9, 1974, to Tacke et al.

In an attempt to further modularize office landscaping systems, systems have been developed comprising a modular support assembly, in which wiring is installed, and a plurality of panel skins suspended on the support assembly after the wiring is in place. An example of such a construction is seen in application, now abandoned Ser. No. 205,734, filed Nov. 10, 1980, entitled PANEL CONSTRUCTION SYSTEM WITH TUBULAR SUPPORT MEANS, and assigned to the assignee of the present application. The support assembly comprises a plurality of tubular members interconnected by brackets having fingers which extend through the member walls. However, this support assembly does not possess the required strength under high load conditions, for example, when cabinets and desks are also supported on the support assembly. The panel skins are suspended on the support assembly by brackets which extend from the panel skins and rest on angled flanges on the support assembly. This panel skin mounting arrangement is unnecessarily complex and expensive.

In other modular construction systems, the panels are suspended on a support assembly by a plurality of hooks which extend from the panels over horizontal support members. Examples of these constructions may be seen in U.S. Pat. No. 4,128,979, entitled SUSPENSION ASSEMBLY FOR PARTITION PANEL, issued Dec. 12, 1978, to Price; U.S. Pat. No. 3,948,011, entitled PARTITION SYSTEM FOR A BUILDING, issued Apr. 6, 1976, to Price et al; and the above-identified patents to Tacke et al. However, these systems do not provide any means for laterally positioning the panel with respect to the support assembly because the clips are free to move laterally with respect to the horizontal members. Consequently, aligning the panels on the support assembly is relatively difficult.

Yet another panel and frame assembly comprises a plurality of spring clips secured to the panel, which clips flex as the panels are installed and lockingly retain the panel on the frame. An example of this construction may be seen in U.S. Pat. No. 3,286,412, entitled PANEL AND FRAME ASSEMBLY, issued Nov. 22, 1966, to Greig et al. However, due to the fact that the springs may flex laterally, this system does not precisely, laterally align the panels on the support assembly.

Although other mechanisms exist for interconnecting either wall panels or wall panel support assemblies, as far as we know these brackets are insufficiently strong under all applicable loads and/or excessively expensive to fabricate and/or excessively complicated to erect.

SUMMARY OF THE INVENTION

The aforementioned problems are solved by the present invention. Essentially, a panel construction assembly is provided comprising a panel supporting assembly and a plurality of panel skins suspended thereon. In one aspect of the invention, the supporting assembly defines a plurality of upwardly opening slots; and the panels each include a plurality of mounting studs slidably received within slots. Each of the studs includes a shaft portion extending through the slot and a head portion to prevent the shaft from pulling out of the slot. Consequently, the panels may be mounted on the support assembly by positioning the panels against the support assembly with each mounting stud immediately above one of the upwardly opening slots and then lowering the panel such that each of the mounting studs is slidably secured within its associated slot. Therefore, the panel is precisely laterally positioned as it is suspended on the supporting assembly, eliminating alignment problems.

In another aspect of the invention, the support structure comprises a plurality of panel frames, each of which in turn includes a first wall portion proximate a generally similar second wall portion of an adjacent frame. The wall portions are interconnected to interconnect the support frames using connecting assemblies, each of which comprises a connecting block defining first and second slot means for receiving the first and second wall portions, respectively, and means for urging the wall portions into the slots in the connecting block. Consequently, adjacent panel supporting frames are rigidly secured together because the wall portions are rigidly secured within the connecting block. Therefore, a support assembly is provided possessing the requisite strength for virtually any office environment load imposed thereon.

In a preferred embodiment of the invention, the panel supporting structure includes a plurality of gussets, each of which defines one of the wall portions and a pair of the upwardly opening slots. In this embodiment, the gussets serve both as an inter-frame connecting bracket and as a support for the panel skins. This further reduces the cost and complexity of fabricating the modular assembly. Additionally, field installation is facilitated due to the relatively small number of parts involved.

These and other objects, advantages, and features of the invention will be more fully understood and appreciated by reference to the written specification and appended drawings.

DESCRIPTION OF THE PREFERRED EMBODIMENT

Figure 1:
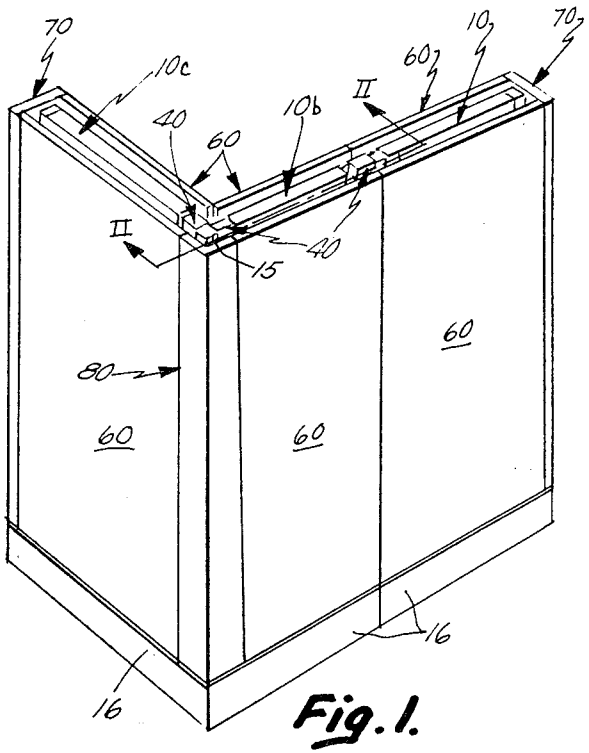
FIG. 1 is a perspective view of the panel construction system showing an L-shaped support frame with wall panels, end caps, and a corner cap supported thereon.
Figure 6:
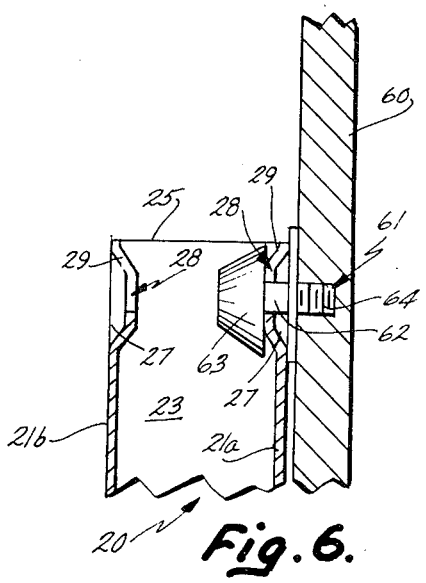
FIG. 6 is a fragmentary, sectional view taken along line VI—VI in FIG. 23 with the connector block removed.

Referring to FIG. 1, an L-shaped panel construction is shown comprising interconnected support frames 10, inner and outer panels or panel skins 60, end caps 70, and corner cap 80. Support frames 10, shown in greater detail in FIG. 2, each include a pair of vertical uprights 11 and 12, upper horizontal member 13, lower horizontal member 14, both extending between the uprights, and four gussets 20 each connecting a vertical member with a horizontal member. Gussets 20 on adjacent support frames 10 are interconnected using connector assemblies 40 to secure the frames together. Corner post 15 is positioned at the corner of the L and secured to adjacent gussets 20 also using connector assemblies 40. Panels 60 are supported on either side of assembled frames 10 to provide planar partitions thereon. More particularly, each gusset 20 defines a pair of upwardly opening slots 28, which slidingly receive studs 61 extending from panels 60 (see FIG. 6). End caps 70 are supported at either end of the L shaped between facing panels 60; and corner cap 80 covers the exterior corner so that a totally finished appearance is obtained. Normally, top caps (not shown), which are identical to end caps 70 are installed along the upper end of the assembly between facing wall panels 60 so that support frames 10 are totally enclosed. The top caps are omitted from FIG. 1 so that support structure 10 may be more clearly shown.

The modular components of the present invention may be used to construct work stations, such as (1) an office station having a desk and a cabinet supported above the desk or (2)a secretary's station including a desk and typewriter attachment. These types of work stations provide totally self-contained work areas which may be easily modified or relocated after initial assembly.

Figure 2:
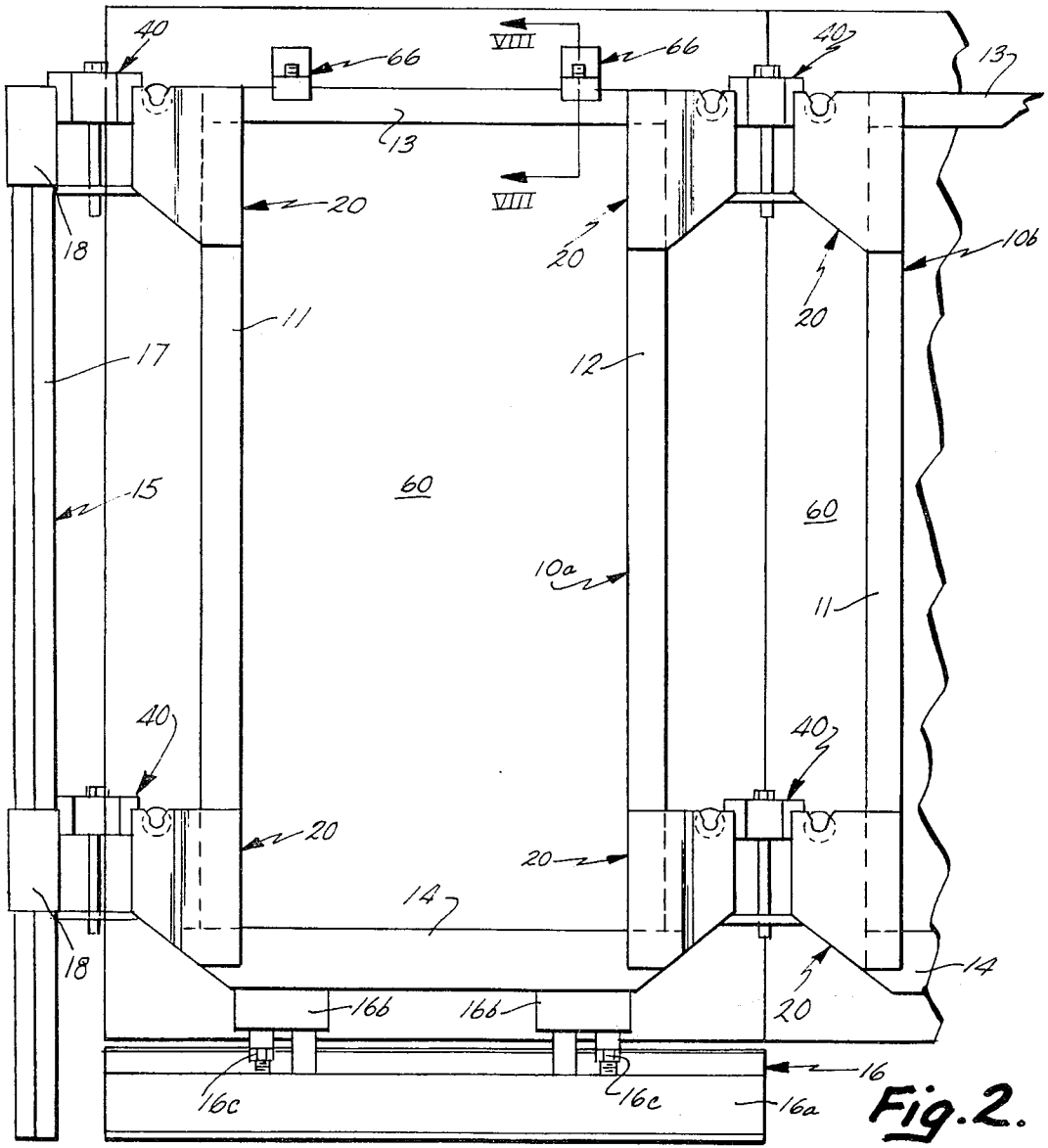
FIG. 2 is a fragmentary view taken along plane II—II in FIG. 1 with the front panels removed.
Figure 7:
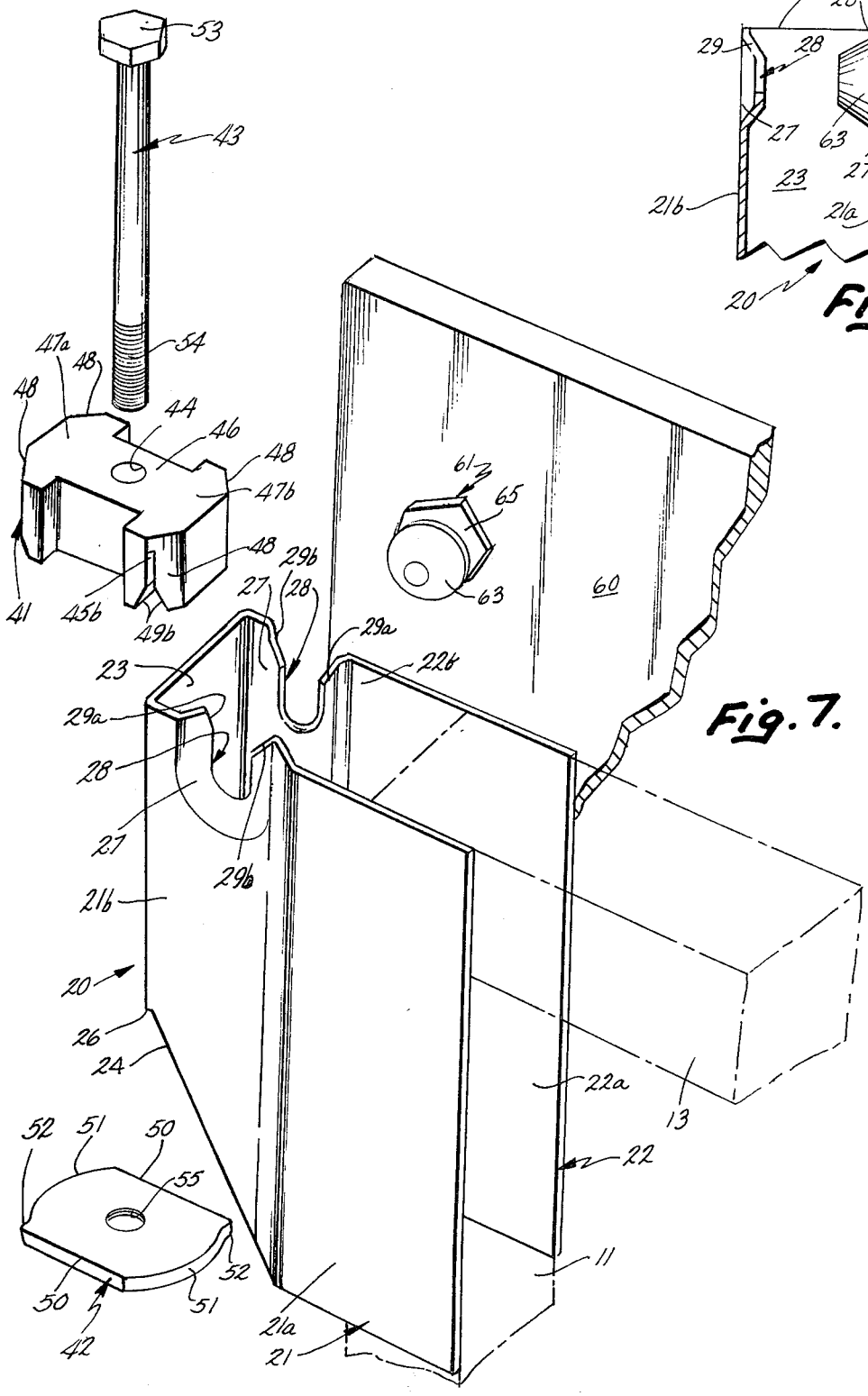
FIG. 7 is a fragmentary, exploded view of a gusset, wall panel, and connector assembly.

Turning more specifically to the construction of support frames 10, it is seen in FIG. 2 that each support frame comprises a pair of spaced, vertical uprights 11 and 12, horizontal top member 13 extending between the uprights, and lower horizontal support member 14 also extending between the uprights. All of members 11, 12, 13, and 14 are tubular; each of members 11, 12, and 13 is generally square in cross section, while lower member 14 is generally rectangular in cross section. Gussets 20 are used to interconnect vertical uprights 11 and 12 with horizontal members 13 and 14, respectively. As seen in FIG. 7, each of gussets 20 includes a pair of spaced sidewalls 21 and 22 between which members 11, 12, 13, and 14 are welded as required at each of the frame corners. Additionally, if desired, the support members may be welded to one another within gussets 20 for further rigidity. Each of frames 10 is supported on a base 16 (FIG. 2) more fully disclosed in copending application Ser. No. 358,091, filed on even date herewith, entitled BASE CONSTRUCTION FOR PANEL SUPPORT ASSEMBLY, assigned to the assignee of the present application, the disclosure of which is incorporated herein by reference. Suffice it to say that base 16 includes a foot **16*a*, support pieces 16*b* secured to the underside of horizontal member 14, and threaded members 16*c* extending between foot 16*a* and support member 16*b* to provide height adjustment between horizontal member 14 and foot 16*a*. Adjacent frames 10 are interconnected by placing gussets 20 from the adjacent frames 10*a* and 10*b* proximate one another and then interconnecting the gussets using connector assemblies 40**.

Gusset 20 (FIGS. 4 and 7) is generally U-shaped in cross section including a pair of parallel sidewalls 21 and 22 interconnected by generally perpendicular end wall or secured portion 23. Sidewalls 21 ans 22 each in turn comprise a pair of spaced, parallel securing portions **21*a* and 22*a* and a pair of spaced, parallel slot-defining portions 21*b* and 22*b*, respectively. The distance between slot-defining portions 21*b* and 22*b* is somewhat less than the distance between securing portions 21*a* and 22*a*. Support members 11, 12, 13, and 14 of support frames 10 interfit, and are secured, between support portions 21*a* and 22*a* (as shown in phantom in FIG. 7). Supporting portions 21*a* and 22*a* and end wall 23 are generally rectangular, while slot-defining portions 21*b* and 22*b* are generally trapezoidal including a lower edge 24 which inclines upwardly from supporting portions 21*a* and 21*b* to end wall 23. Each of end walls 23 includes an upper edge 25 and a lower edge 26. Slot-defining portions 21*b* and 22*b* define pockets or depressions 27, which extend inwardly toward one another and in turn define slots 28, which receive the panel supporting studs 61 (see also FIG. 6). Each of slots 28 is generally U-shaped and opens upwardly. The upper edges 29*a* and 29*b* of each slot 28 are beveled downwardly and inwardly toward opposite slot 28 so that studs 61 are drawn toward the center of gusset 20 as panels 60 are mounted on frames 10. Additionally, upper edges 29*a* and 29*b* of each slot 28 are beveled downwardly toward one another to define an upwardly opening V to facilitate insertion of mounting studs 61** into the slots.

Connector assembly 40 (FIGS. 4 and 7) generally comprises connector block 41, bearing plate 42, and bolt 43 extending therebetween. When viewed from above (FIG. 7) block 43 has generally an H-shape comprising central portion 46 and opposite, cross portions **47*a* and 47*b*. Central portion 46 defines central vertical aperture 44; and cross portions 47*a* and 47*b* define a pair of spaced, parallel slots 45*a* and 45*b* opening downwardly and extending through the block. Additionally, the four corners 48 of block 43 are each beveled at approximately a 45° angle. Additionally, the opening portions 49a and 49b of slots 45a and 45b, respectively, are beveled or flare outwardly from one another to provide a funneling effect into slots 45**.

Figure 5:
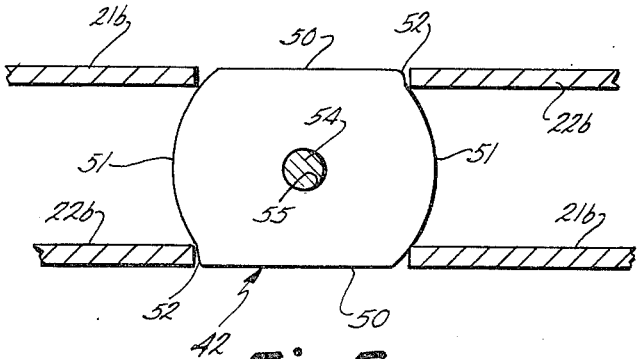
FIG. 5 is a fragmentary, sectional view taken along plane V—V in FIG. 4.

Bearing plate 42 (FIGS. 5 and 7) is a generally planar member defined by generally parallel sides 50 and arcuate sides 51 extending therebetween. Plate 42 defines a threaded aperture 55; and the radius of arcuate sides 51 from aperture 55 is equal to the distance between aperture 55 and sidewalls 21 and 22 in the connected assembly (see FIG. 5). Additionally, camming lobes 52 are provided kitty-corner one another at the junction of a straight side 50 with an arcuate side 51. Consequently, plate 42 may be positioned between adjacent gussets 20 and rotated into position with arcuate surfaces 51 traveling along sidewalls 21 and 22 until camming lobes 52 abut sidewalls 22b to position the plate as shown in FIG. 5.

Bolt 43 is an elongated member having hex head 53 at one end and threaded portion 54 at its opposite end. In assembled connector 40, bolt 43 extends rotatably through aperture 44 and is threadedly secured within aperture 55 in camming plate 52.

Figure 3:
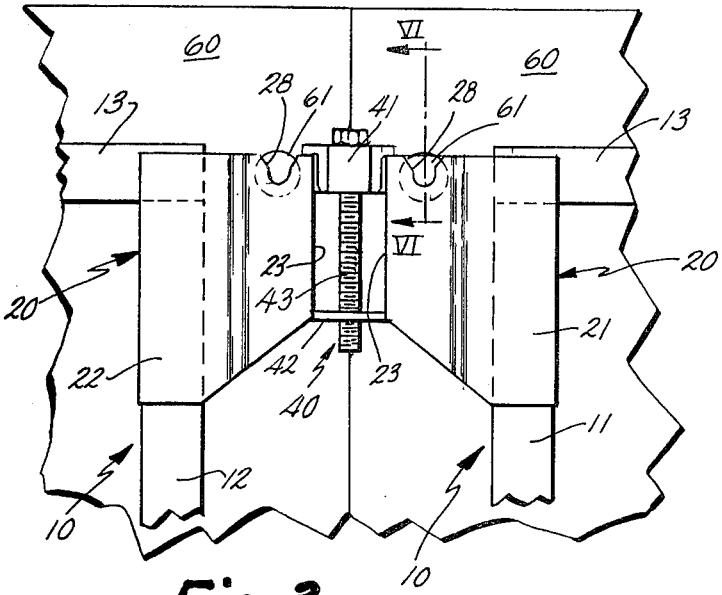
FIG. 3 is a fragmentary, enlarged view of two gussets from adjacent support frames interconnected with a connector assembly.
Figure 4:
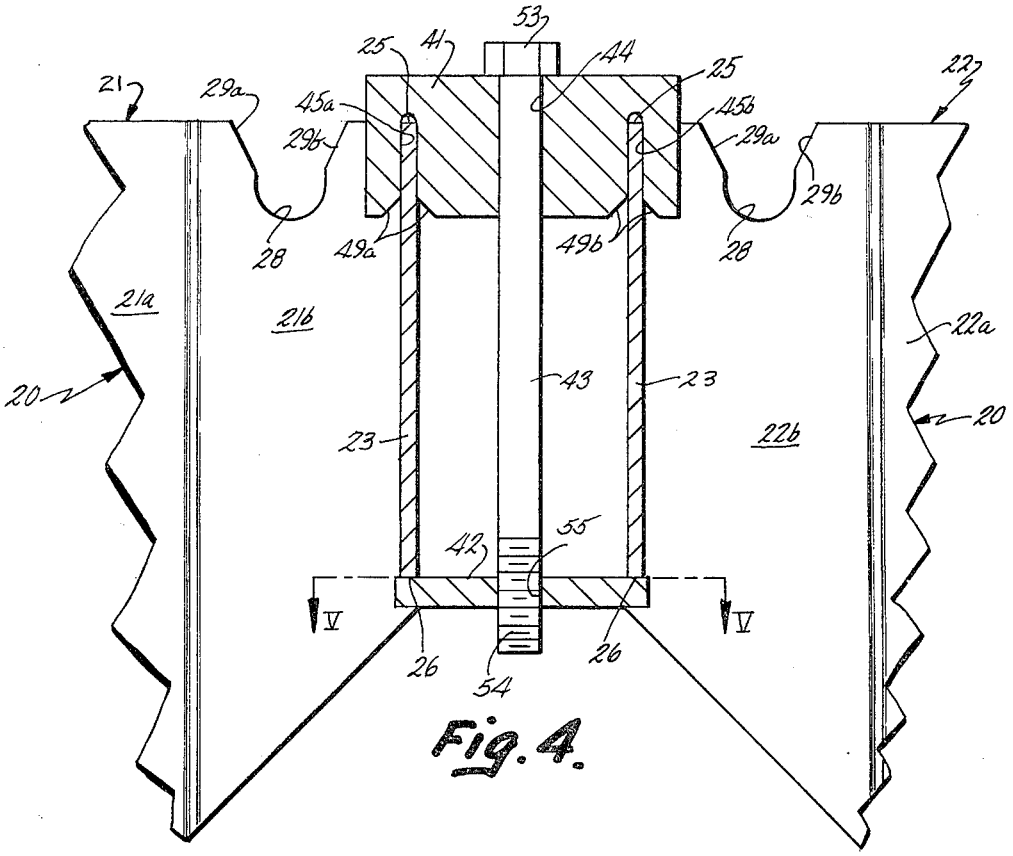
FIG. 4 is a fragmentary, sectional view of the structure shown in FIG. 3.

FIGS. 3 and 4 illustrate the interconnection of two adjacent gussets 20 using connector assembly 40. Both of end walls 23 of adjacent gussets 20 are positioned within slots 45a and 45b in block 41. Bolt 43 is then inserted through aperture 44 in block 41, and initially threaded into aperture 55 in plate 42. Optionally, connecting assembly 40 may be preassembled so that block 41, plate 42 and bolt 43 with the bolt passing through both block 41 and plate 42. In either event, bearing plate 42 is then rotated until in the position shown in FIG. 5 wherein sides 50 are generally parallel to sidewalls 21 and 22 and wherein camming lobes 52 abut walls 22b. Bolt 43 is then tightened drawing bearing plate 42 upwardly against lower ends 26 of end walls 23 and drawing connecting block 41 down onto upper ends 25 of the end walls. Consequently, end walls 23 are forced upwardly into slots 45 and into connector block 41 to be securely and rigidly held between the connector block and bearing plate 42. When each of the adjacent gusset pairs is connected, frames 10 are rigidly secured, or interconnected, together.

Panels 60 (FIGS. 6 and 7) are generally planar members fabricated of fiberglass. Panels 60 may optionally be covered with fabric (not shown) to give panels 60 a particular texture and color desired in a particular application. Of course, panels 60 may be fabricated of other materials, for example wood. A plurality of mounting studs 61 are mounted in the rear surface of panels 60 to be positioned within slots 28 when panels 60 are mounted on frames 10. Each of studs 61 includes shaft portion 62 having frustoconical head 63 integrally molded thereon. The diameter of shaft 62 is substantially the same as the width of slot 28. Head 63 has an outer diameter greater than the diameter of shaft 62 to retain stud 61 within a slot 28. Threaded portion 64 extends from shaft 62 and is threadedly secured within panel 60. A hex head flange 65 extends radially between shaft 62 and threaded portion 64 to facilitate installation of studs 61 in panel 60. Additionally, studs 61 are secured within panel 60 using adhesive or binder to strengthen the stud-to-panel connection.

Figure 8:
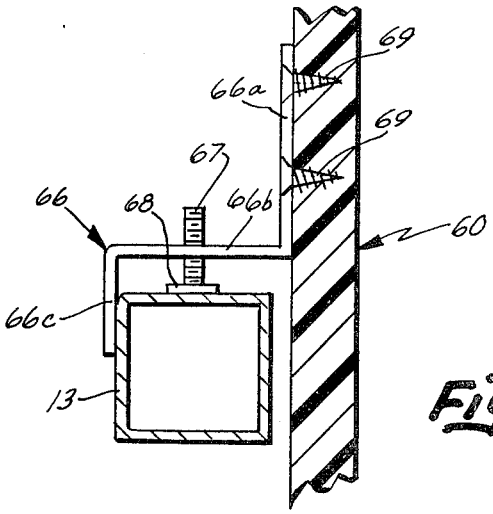
FIG. 8 is a fragmentary, sectional view taken along plane VIII—VIII in FIG. 2.

Two height adjusting brackets 66 (FIGS. 2 and 8) are secured to panel 60 to suspend the panel from upper horizontal member 13. As most clearly seen in FIG. 8, bracket 66 is generally Z-shaped comprising securing flange 66a, horizontal flange 66b, and retention flange 66c. A threaded member 67 having an integral foot 68 thereon is threadedly carried within horizontal flange 66b so that the foot rests on horizontal member 13. Securing flange 66a is fastened to panel 60 using screws 69. When panel 60 is installed on frame 10, horizontal member 13 is located between the panel 60 and retention flange 66c with foot 68 resting on the horizontal member. By rotating threaded member 67 within horizontal flange 66b, the height of bracket 66, and consequently panels 60, may be adjusted above horizontal member 13 to precisely vertically align each panel.

Figure 9:
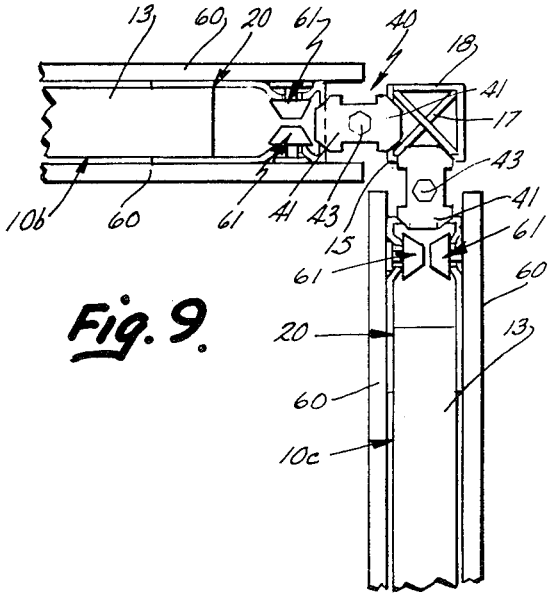
FIG. 9 is a top plan view of the corner of the panel assembly shown in FIG. 1 with the end cap removed.

FIGS. 2 and 9 illustrate a corner construction for the wall panel system, wherein corner post 15 is used to join two frames 10 at right angles. Corner post 15 comprises a body portion 17, having a generally X-shaped cross section (see FIG. 9), and sleeves or gussets 18 wrapped about and secured to the X-shaped body. Sleeves 18 are located at approximately the same height above the floor as end walls 23 of gussets 20; additionally, sleeves 18 are approximately the same height as end wall 23. Two frames 10b and 10c are joined at right angles by first connecting one frame to corner post 15, interconnecting sleeves 18 with gussets 20 of frame 10a using connecting assemblies 40. A second frame is then oriented at generally a right angle to the first frame 10a and secured to corner post 15 by interconnecting sleeves 18 and gussets 20 of frame 10b using connecting assemblies 40. Corners 48 on blocks 41 permit block 41 to be installed on post 15 with sleeve 18 positioned in groove 45 and with corners 48 engaging the legs of X-shaped body 17 (see FIG. 9). Although only a right-angle corner assembly has been described, up to four frames 10 may be connected to corner post 15 all at generally right angles thereto.

Finally, end caps 70 and corner cap 80 are generally well known to those having ordinary skill in the art. Suffice it to say that caps 70 and 80 are suspended on frames 10 as necessary to totally enclose the support frames 10.

Assembly

The modular panel system of the present invention is shipped to an installation sight as a plurality of components. These modular components include frames 10 having gussets 20 mounted thereon, connector assemblies 40, panels 60, end caps 70, and corner caps 80. The support structure is first assembled by interconnecting a plurality of support frames 10 into the desired partitioning configuration. Adjacent frames 10 which are parallel to one another are connected by securing adjacent gussets from the two frames together using connector assemblies 40. Frames 10 which are oriented at right angles to one another are connected to a common corner post 15 by interconnecting sleeves 18 on the corner post with gussets 20 on each frame.

After frames 10 have been interconnected, panels 60 are then suspended thereon. Each panel 60 is positioned against a frame 10 with studs 61 positioned above one of slots 28 defined by gussets 20 and with brackets 66 positioned above upper horizontal member 13. The panel is then lowered so that studs 61 slidingly engage slots 28, more particularly with shaft 62 positioned within the slot and head 63 located within the gussset opposite panel 60, until feet 68 of adjusting screws 67 rest on member 13. Head 63 prevents stud 61 from pulling out of slot 28. Further, because shafts 62 have substantially the same width as slots 28, studs 61 center panel 60 with respect to frame 10 as the panel is lowered onto the frame. The upper edges 29 of each slot 28 guide the associated shaft 62 into the slot as the panel is lowered. Additionally, beveled edges 29 force head 63 inwardly into gusset 20 drawing panel 60 tightly against frame 10. Height-adjusting screws 67 are then adjusted as necessary to vertically align panel 60 on frame 10. Finally, end caps 70 and corner caps 80 are installed to enclose frames 10, giving the wall panel system a neat and finished appearance. Optionally, a top cap (not shown) may be installed along the upper surface of the wall panel assembly to totally enclose the support structure.

It should be understood that the above description is intended to be that of a preferred embodiment of the invention. Various alterations and changes might be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A panel construction assembly comprising:

a panel support frame assembly including first and second spaced uprights and first and second gussets including plate support means secured to said first and second uprights, respectively, said first and second gussets extending toward one another from said uprights to space said plate support means from said uprights, each of said gussets defining an upwardly opening slot, each slot including a portion beveled downwardly inwardly with respect to said gusset;

a connector block defining first and second slot means for slidingly receiving said first and second plate support means, respectively;

means for urging said first and second plate support means into said connector block to secure said spaced uprights together;

a wall panel; and a mounting stud extending from said wall panel and secured within one of said gussets, said stud including a shank slidably positioned within one of said beveled slots and a head connected to said shank to prevent said shank from pulling out of said slot, whereby said wall panel is drawn toward said gussets and frame as said stud slides downwardly within said slot to removably suspend said panel on said frame.

2. The panel construction of claim 1 in which the first and second plate support means are each a wall of a gusset.

3. A panel construction assembly as defined in claim 1 wherein each of said first and second gussets comprises:

first and second sidewalls secured to opposite sides of said upright; and an end wall secured between said sidewalls and extending into said connector block, said end wall constituting the plate support means.

4. A panel construction assembly as defined in claim 1 wherein third and fourth uprights of said panel support frame assembly are provided each having a gusset including plate support means secured to and spaced from said upright; a second connector block is provided having first and second slot means for slidingly receiving said plate support means of said third and fourth gussets, respectively; and means for urging said third and fourth gussets into said second connector block.

5. A panel construction assembly as defined in claim 1 wherein said urging means comprises:

a bearing plate abutting said first and second plate support means and spaced from said connector block; and means for drawing said bearing plate toward said connector block to secure said first and second plate support means therebetween.

6. A panel construction assembly as defined in claim 5 wherein said drawing means comprises a threaded member.

7. A panel construction assembly as defined in claim 1 wherein said frame assembly further comprises a horizontal member supported by at least one of said first and second uprights; and wherein said panel construction assembly further comprises means for adjusting the height of said wall panel with respect to said horizontal member.

8. A panel construction assembly as defined in claim 7 wherein said height-adjusting means comprises:

a bracket member extending from said wall panel and over said horizontal member; and a generally vertically oriented threaded member supported within said bracket member and engaging said horizontal member, whereby as said threaded member is rotated in first and second directions, said bracket member is shifted upwardly and downwardly with respect to said horizontal member.

9. A panel construction assembly comprising:

means for supporting a wall panel, said means including a frame and a plurality of gussets extending from said frame, said gussets defining a plurality of vertical slots, each slot being inclined downwardly inwardly with respect to said panel support means;

a wall panel; and a plurality of attachment studs extending from said panel, each of said studs comprising a shank portion slidingly received in one of said slots and a head portion coupled to said shank portion to retain said shank portion within said slot, said gussets having access means located above said slots permitting said head to pass from one side of said gusset to the other side thereof providing access to said slots for said shank portion whereby said wall panel is removably secured to said support means and is drawn inwardly toward said panel support means as said studs slide downwardly within said slots.

10. A panel construction assembly as defined in claim 9 in which said access means is an upward opening in said slot located at the edge of said gusset.

11. A panel construction assembly as defined in claim 9 or 10 wherein each of said gussets is generally U-shaped in cross section and comprises a pair of sidewalls and an end wall extending between said sidewalls, and wherein one of said sidewalls defines said upwardly opening slot.

12. A panel construction assembly as defined in claim 9 wherein said studs further comprise a threaded portion threadedly secured within said wall panel.

13. A panel construction assembly as defined in claim 12 wherein said studs further comprise a hex portion to facilitate installation of said studs within said wall panel.

14. A wall panel support structure comprising:

first panel supporting frame means including a first gusset extending outwardly therefrom, said first gusset including a pair of sidewalls and an end wall extending between said sidewalls, said end wall comprising a first secured portion;

second panel supporting frame means including a second gusset extending outwardly therefrom toward said first gusset, said second gusset including a pair of sidewalls and an end wall extending between said sidewalls, said end wall comprising a second secured portion;

a connecting block defining first and second slots in which said first and second secured portions, respectively, are slidingly received;

a bearing member engaging said first and second secured portions and spaced from said connecting block; and means for drawing said connecting block and said bearing member toward one another to secure said secured portions therebetween to secure said first and second frame means together.

15. A wall panel support structure as defined in claim 14 wherein said drawing means comprises a threaded member extending between said connecting block and said bearing member.

16. A wall panel support structure as defined in claim 15 wherein said bearing member comprises a generally planar bearing plate having a first end bearing against said first secured portion and a second end bearing against said second secured portion.

17. A wall panel support structure as defined in claim 16 wherein each of said bearing member ends is located between one of said pairs of sidewalls.

18. A wall panel support structure comprising:

first panel supporting frame means including a first secured portion comprising a pair of sidewalls secured to the remainder of said first frame means and an end wall extending between said sidewalls;

second panel supporting frame means including a second secured portion comprising a pair of sidewalls secured to the remainder of said second frame means and an end wall extending between said sidewalls;

a connecting block defining first and second slots in which said first and second secured portions, respectively, are slidingly received;

a generally planar bearing plate spaced from said connecting block and including a first end bearing against said first secured portion between said first pair of sidewalls and a second end bearing against said second secured portion between said second pair of sidewalls, said first and second ends being generally arcuate to facilitate positioning of said bearing plate between said sidewalls; and means for drawing said connecting block and said bearing member toward one another to secure said secured portions therebetween to secure said first and second frame means together, said drawing means comprising a threaded member extending between said connecting block and said bearing plate.

19. A wall panel support structure as defined in claim 18 wherein said arcuate ends include cams extending outwardly therefrom and engaging said side walls to prevent said bearing member from rotating during rotation of said threaded member.

20. A wall panel support structure comprising:

a first frame including a pair of spaced vertical upright members, an upper horizontal member secured to the top portions of the upright members, a lower horizontal member secured to the lower portions of the upright support members, upper and lower plate support means secured to said upright members adjacent each of the connections of said lower and upper horizontal members, respectively, to said upright members, said plate support means each extending in a vertical direction and spaced outwardly from the upright to which it is secured;

a second frame having the same construction as said first frame and located with respect to said first panel so that two of its plate support means are located in opposed, spaced relationship to two of said plate support means of said first frame;

a connecting block for each of said opposed plate means and defining first and second slots in which the upper portions of said opposed plate support means are slidingly received;

a bearing member for each of said opposed plate support means and engaging the lower portions of said opposed plate support means; and means for drawing said connecting block and said bearing member toward each other to secure said opposed plate support means together, whereby said uprights to which said opposed plate support means are secured together in a relationship providing a space therebetween.

* * * * *